US005954247A

United States Patent [19]

Savine et al.

[11] Patent Number: 5,954,247

[45] Date of Patent: Sep. 21, 1999

[54] BOTTLE HOLDER

[75] Inventors: Cazin Savine; Vothe Hang; Keigo Hiramatsu, all of Seclin Cedex, France

[73] Assignee: YKK Corporation, Tokyo, Japan

[21] Appl. No.: 09/034,569

[22] Filed: Mar. 4, 1998

[30] Foreign Application Priority Data

Mar. 4, 1997 [FR] France ..... 97 02555

[51] Int. Cl.[6] ..... A45F 3/16

[52] U.S. Cl. ..... 224/148.4; 215/399; 224/148.1; 224/148.6; 224/257; 224/600; 224/601

[58] Field of Search ..... 224/148.4, 148.5, 224/148.6, 148.7, 201, 600, 601, 604, 615, 257, 265, 267; 215/306, 390, 399; 294/31.2, 90, 93, 119.2, 145, 149, 165; 248/102

[56] References Cited

U.S. PATENT DOCUMENTS 5,577,647 11/1996 Pittarelli et al. ..... 224/148.6

5,765,888 6/1998 Stack ..... 294/27.1

*Primary Examiner*—Allan N. Shoap

*Assistant Examiner*—Maerena W. Brevard

*Attorney, Agent, or Firm*—Hill & Simpson

[57] ABSTRACT

A bottle holder is adapted to engage the neck of a bottle below an external annular flange of said neck, especially for suspending a bottle by means of a cord to the neck of a person. The bottle holder comprises, in combination, a cord, and a ring segment-shaped collar member made from an elastic material and comprising a ring segment comprising at each of its ends means for guiding and releasably clamping said cord such that said collar member and said cord may be set in untightened state on a container neck and then be gripped around the neck by pulling said cord and maintained gripped by said clamping means.

9 Claims, 2 Drawing Sheets

BOTTLE HOLDER

BACKGROUND OF THE INVENTION

1. Field of the Invention

The present invention relates to a bottle holder adapted to engage the neck of the bottle, for suspending a bottle by means of a cord e.g. to the neck of a person.

2. Description of the Prior Art

Known bottle holders of that kind comprise a flat ring-shaped collar member made from rubber or rubber like materials, the collar member further comprising a hole for connecting it to the suspension cord either directly or by means of a connecting ring, a swivel and/or a snap hook. Such a collar member is intended to be fit to bottle necks of one size, the inner diameter of the ring-shaped collar member being adapted to the outer diameter of the neck of the bottles to be held. However, there are many different sizes of bottle necks and the material of the known bottom holders is not flexible enough to allow one holder to adapt to different sizes of bottle necks without involving excessive deformation. For the same reasons, the known bottle holder is not easy to fit on and to remove from the neck of the bottles and is not durable.

SUMMARY OF THE INVENTION

With the foregoing difficulties in view, it is therefore an object of the present invention to provide a bottle holder which can easily adapt to different sizes of bottle necks. Another object of the invention is to provide a bottle holder which is simple in construction and easy in use. A further object of the invention is to provide a bottle holder which can be manufactured at low cost. Still another object of the invention is to provide a bottle holder which has a higher durability than the known ones.

The bottle holder according to the invention is adapted to engage the neck of a bottle, below an external annular flange of said neck, for suspending a bottle by means of a cord e.g. to the neck of a person. The bottle holder comprises a cord and a ring segmentshaped collar member made from an elastic material and comprising at each of its ends means for guiding and releasably clamping said cord such that said collar member and said cord may be set in untightened (loose) state on a container neck and then be gripped around the neck by pulling said cord and maintained gripped by said clamping means.

As long as the cord is not tightened between the two ends of the ring segment-shaped collar member, the bottle holder is easy to set on bottle necks of different sizes, due to elasticity of the collar member. After that, by pulling the cord, the user can easily tighten the portion of the cord between the ends of the collar member, so that the collar member and the cord fit to and grip the bottle neck whatever may be the size of the latter.

Preferably, each of said clamping means is adapted to provide self-clamping of the cord after tightening and to be actuated for unclamping and untighening (loosing) the cord.

Each of said clamping means is preferably one-piece molded with the ring segment of the collar member.

Each of said clamping means may comprise a hole for passing through the cord at each end of the ring segment of the collar member and a pawl-like element self-acting on the cord for clamping it.

The pawl-like element may comprise a rocking lever member connected between its opposite ends to the ring segment of the collar member by a connection portion containing said hole, a first end portion of said lever member being provided with a tooth for clamping the cord as it emerges from said hole and the opposed second end of said lever member being an actuating portion for unclamping the cord when depressed.

The connection portion of the lever member is acting as a spring hinge so that when said actuating portion is depressed, the lever member rocks about the connection portion and the clamping tooth releases the cord.

Preferably, the axes of the holes for passing the cord are substantially perpendicular to the axis of the collar member.

The connection portion of the lever member may define, between said first end of the lever and the outer side wall of the ring segment of the collar member, a groove substantially parallel to the axis of the collar member, having a semi-circular cross section with a radius corresponding substantially to the radius of the cord.

The cord which defines the bottle holder in combination with the collar member may be a cord independent from the cord used for suspending the bottle holder, e.g. around the neck of a person, or may preferably be a portion of the suspension cord.

Many other advantages and features of the present invention will become manifest to those versed in the art upon making reference o the detailed description and the accompanying sheets of drawings in which preferred structural embodiments incorporating the principles of the present invention are shown by way of illustrative example.

DETAILED DESCRIPTION

Figure 1:
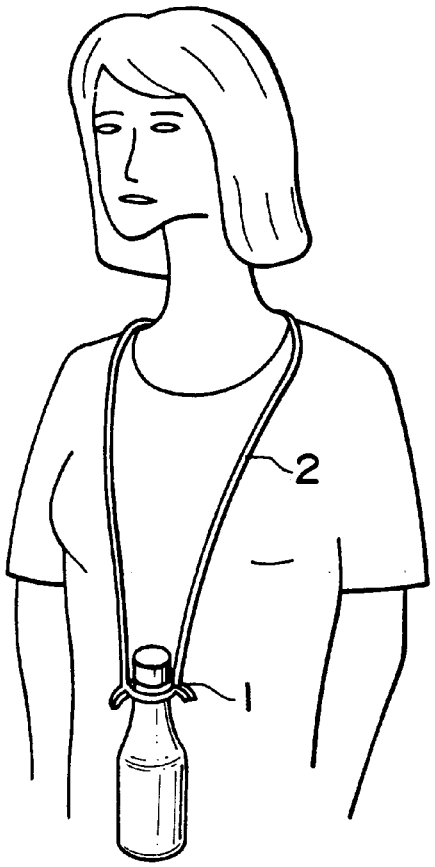
FIG. 1 shows a bottle suspended by a bottle holder according to the invention to the neck of a person.

According to FIG. 1, a person has a bottle containing e.g. a beverage suspended at his neck by means of a cord connected to the neck of the bottle through bottle holder.

Figure 2:
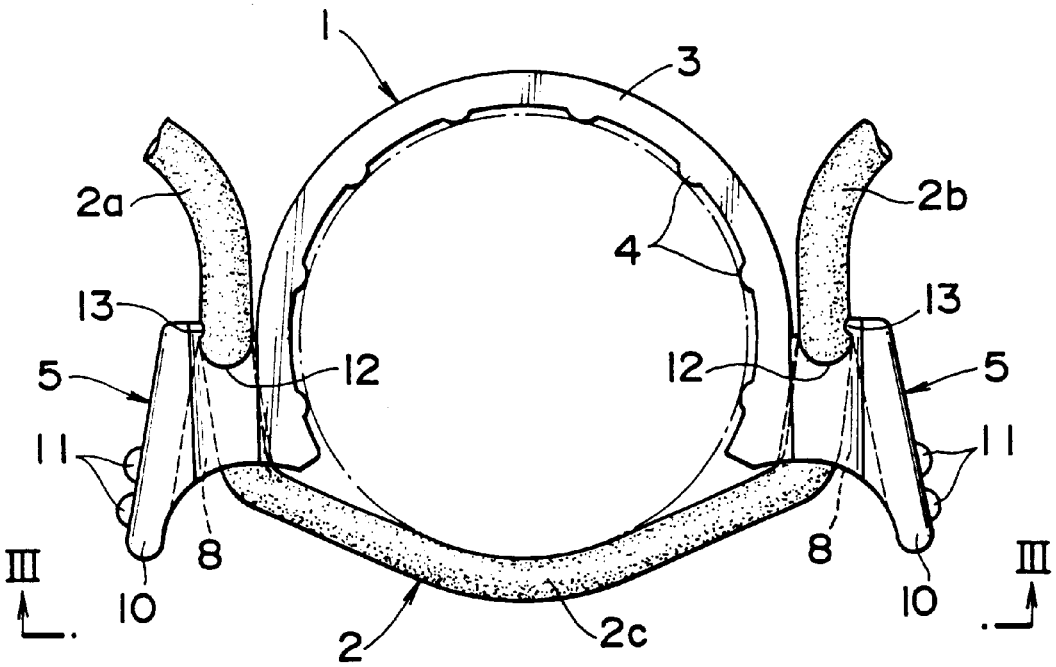
FIG. 2 is a plan view of the bottle holder gripped around a bottle neck, with the collar member completed by the cord.
Figure 3:
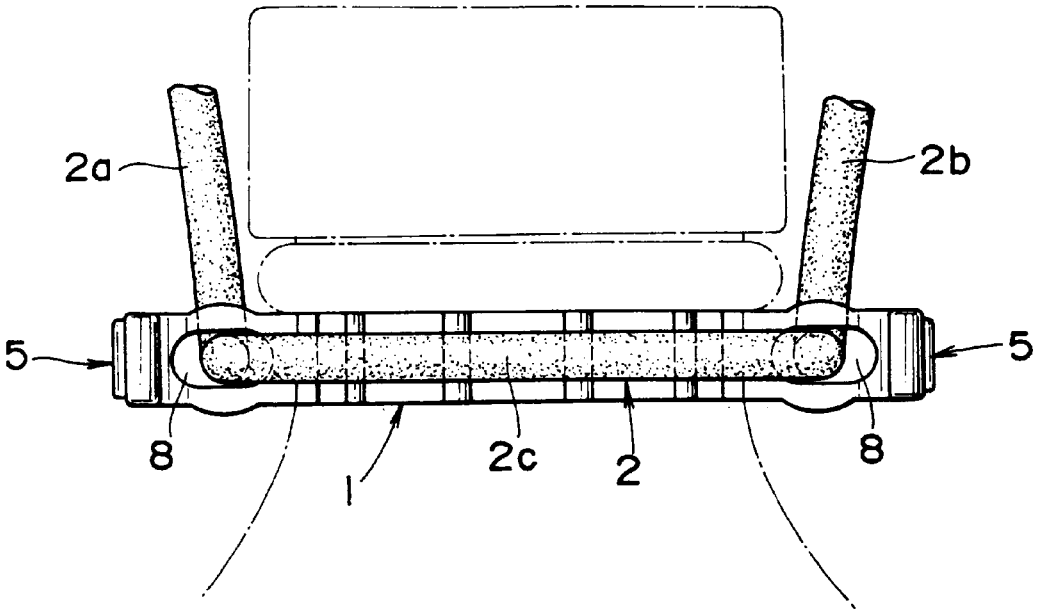
FIG. 3 is a view along the arrow III on FIG. 2.

As shown on FIG. 2 and FIG. 3, the bottle holder comprises a ring segment-shaped collar member 1 and a cord 2 which may be a portion of the suspension cord.

Figure 4:
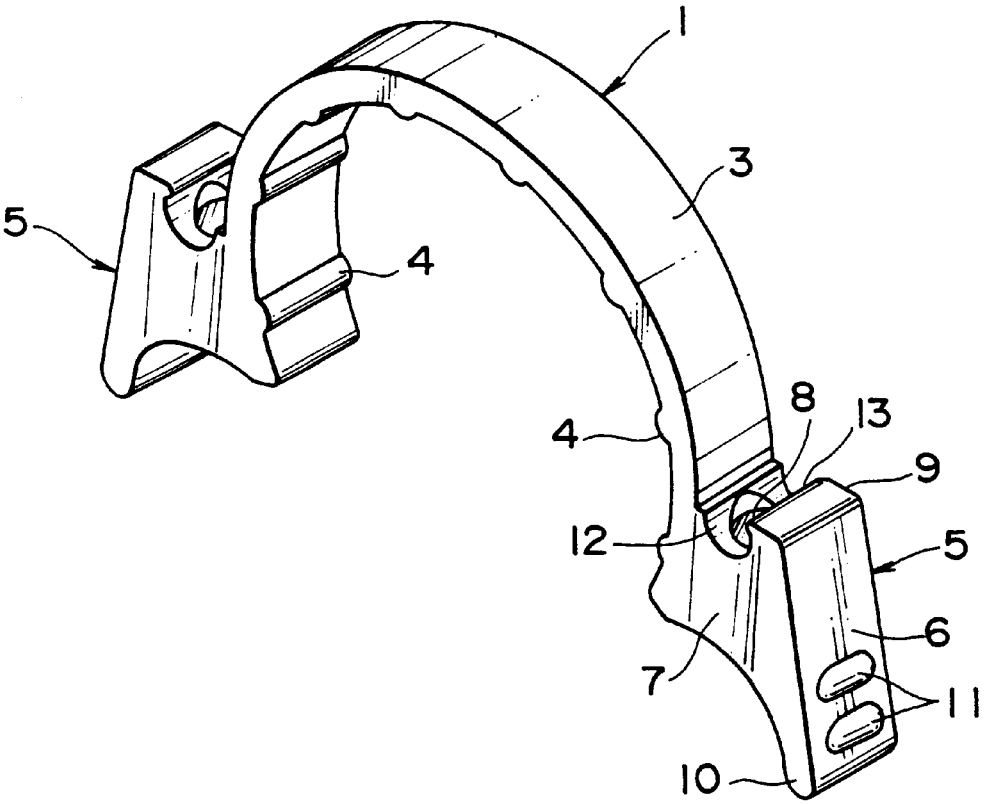
FIG. 4 is a perspective view of the collar member of the bottle holder according to the invention.

The collar member 1 as shown especially on FIG. 4 comprises a ring segment 3 extending over more than 180 degree, e.g. over about 230 degree as shown. On its inside, the ring segment 3 is provided with a plurality of axial beads 4 circumferentially spaced from each other, e.g. with 8 beads spaced about 30 degree from each other. Near each of its end portions, the ring segment 3 comprises on its outer side a clamping means 5 for the cord 2. The clamping means 5 comprises a rocking lever-shaped member 6 connected to the ring segment 3 by a connection portion 7. The connection portion 7 contains a hole 8, the holes of the two connection portions 7 at the two ends of the ring segment 3 being substantially parallel to each other and substantially perpendicular to the axis of the ring segment 3.

The diameter of the holes 8 is equal to or slightly greater than the diameter of the cord 2 so that the cord can be easily passed through said holes 8.

The rocking lever member 6 is provided with two opposed end portions 9 and 10 projecting in opposite directions from said connecting portion 7. The end portion 10 is an actuating portion provided on its outside, i.e. on its side that is away from the ring segment 3 with anti-slide bosses or ribs 11. The other end portion 9 is separated from the ring segment 3 by a groove 12 extending parallel to the axis of the ring segment 3 and having a semi-circular cross section with a radius corresponding substantially to the radius of the cord 2. The inner free end edge of the end portion 9 facing the ring segment 3 projects toward the ring segment 3, thus forming a clamping tooth 13.

The cord 2 is passed through the two holes 8 of the collar member 1 such that, as shown especially on FIG. 2, the two end portions 2*a*, 2*b* of the cord 2 emerge from the hole 8 of the collar member 1 toward the ring segment 3, i.e. on the side of the grooves 12 of the connection portions 7, toward the clamping teeth 13, while the intermediate portion 2*c* of the cord 2 extends between the free ends of the collar member 1, thus completing the ring segment 3 for forming a complete ring.

Prior to setting the bottle holder on a container neck shown in broken lines on FIG. 2 and 3, the two clamping means 5 at both ends of the collar member 3 are unclamped, by clamping the actuating portions 10 between the fingers of one hand, and the intermediate portion 2*c* of the cord 2 is pulled away from the ring segment 3, thus untightening (loosing) the intermediate portion 2*c* of the cord. The holder can thus be set on the container neck, the collar member 3 being elastically expandable. The user then pulls one of the end portions 2*a* and 2*b*, for tightening the intermediate portion 2*c* and gripping the collar member 3 and the intermediate portion 2*c* of the cord 2 around the bottle neck. The clamping means 5, without being actuated, allow the cord 2 to slide in the pulling direction and provide a self-clamping action preventing any sliding of the cord 2 in the opposite direction and any untightening (loosing).

After having been pulled in order to tighten the intermediate portion 2*c* of the cord 2 and to grip the holder around the bottle neck, the end portions 2*a*, 2*b* of the cord 2 may be pulled upwardly as shown in FIG. 3, so as to be fixed in the groves 13 and extend upwardly.

In the preferred case where the cord 2 used for clamping the collar member 1 is a portion of the cord for suspending the bottle holder, e.g. to the neck of a person as shown in FIG. 1, the portions 2*a*, 2*b* of the cord arc thus fixed in the grooves 13 in the correct position for extending upwardly around the neck of the person.

Due to the elasticity of the material of the collar member 1, the latter, if manufactured e.g. with an inside diameter of about 25 mm, may easily adapt to bottle necks with diameters between about 15 mm (the ends of the collar member being close to each other) and 50 mm or more.

Obviously, various modifications and variations of the present invention arc possible in the light of the above teaching. It is therefore to be understood that within the scope of the appended claims the invention may be practiced otherwise than as specifically described.

What is claimed:

1. A bottle holder adapted to engage the neck of a bottle below an external annular flange of said neck, especially for suspending a bottle by means of a cord to the neck of a person, characterized in that it comprises, in combination, a cord, and a ring segment-shaped collar member made from an elastic material and comprising at each of its ends means for guiding and releasably clamping said cord such that said collar member and said cord may be set in untightened state on a container neck and then be gripped around the neck by pulling said cord and maintain the grip by said clamping means.

2. A bottle holder according to claim 1 characterized in that each of said clamping means is adapted to provide self-clamping of the cord after tightening and to be actuated for unclamping and untightening the cord.

3. A bottle holder according to claim 2, characterized in that each of said clamping means is one-piece molded with the ring segment of the collar member.

4. A bottle holder according to claim 3, characterized in that each of said means comprises a hole for passing through the cord at the end of the collar member and a pawl-like member self-acting on the cord.

5. A bottle holder according to claim 4, characterized in that the pawl-like member is a rocking lever member connected between its opposite ends to the ring segment by a connection portion containing said hole, a first end portion of said lever member being provided with a tooth for clamping the cord and the opposed second end portion being an actuating portion such that when said actuating portion is depressed, the lever member rocks about the connection portion acting as a spring hinge and the tooth releases the cord.

6. A bottle holder according to claim 5, characterized in that the axes of the holes are substantially parallel to one another and substantially perpendicular to the axis of the collar member.

7. A bottle holder according to claim 6, characterized in that the connection portion defines, between said first end portion of the lever member and the outside wall of the ring segment of the collar member, a groove extending substantially parallel to the axis of the collar member.

8. A bottle holder according to claim 7, characterized in that said groove has a semi-circular cross section with a radius corresponding substantially to the radius of the cord.

9. A bottle holder according to any one of the preceding claims, characterized in that the cord clamped to the collar member is the cord for suspending the bottle holder.

* * * * *